US007464477B2

(12) United States Patent
Afshari

(10) Patent No.: US 7,464,477 B2
(45) Date of Patent: Dec. 16, 2008

(54) BOW SIGHT WITH ANGLED PINS

(76) Inventor: Abbas Ben Afshari, P.O. Box 6005, Pocatello, ID (US) 83205

( * ) Notice: Subject to any disclaimer, the term of this patent is extended or adjusted under 35 U.S.C. 154(b) by 0 days.

(21) Appl. No.: 11/153,909

(22) Filed: Jun. 15, 2005

(65) Prior Publication Data

US 2006/0283028 A1 Dec. 21, 2006

Related U.S. Application Data

(63) Continuation-in-part of application No. 11/079,004, filed on Mar. 11, 2005, now Pat. No. 7,200,943, which is a continuation-in-part of application No. 10/435,943, filed on May 12, 2003, now Pat. No. 6,938,349, which is a continuation-in-part of application No. 09/989,935, filed on Nov. 20, 2001, now Pat. No. 6,560,884, which is a continuation-in-part of application No. 09/991,243, filed on Nov. 20, 2001, now Pat. No. 6,725,854.

(51) Int. Cl.
*F41G 1/467* (2006.01)

(52) U.S. Cl. ..... 33/265; 124/87

(58) Field of Classification Search ..... 33/265; 124/87

See application file for complete search history.

(56) References Cited

U.S. PATENT DOCUMENTS

| | | | | |
|---|---|---|---|---|
| 3,234,651 A | | 2/1966 | Rivers | |
| 3,365,800 A | * | 1/1968 | Carella | 33/265 |
| 3,455,027 A | | 7/1969 | Perkins | |
| 3,475,820 A | | 11/1969 | Kernan | |
| 3,521,362 A | | 7/1970 | Duplechin | |
| 3,641,675 A | | 2/1972 | Funk, Jr. | |
| 3,648,376 A | | 3/1972 | Millnamow | |
| 3,849,894 A | * | 11/1974 | Brougham | 33/265 |
| 3,945,127 A | | 3/1976 | Spencer | |
| 3,997,974 A | | 12/1976 | Larson | |
| 4,116,194 A | | 9/1978 | Topel | |
| 4,120,096 A | | 10/1978 | Keller | |
| 4,159,575 A | | 7/1979 | Kalmbach | |
| 4,162,579 A | | 7/1979 | James | |
| 4,177,572 A | | 12/1979 | Hindes | |
| 4,215,484 A | | 8/1980 | Lauffenburger | |
| 4,244,115 A | | 1/1981 | Waldorf | |
| 4,291,664 A | | 9/1981 | Nishioka | |
| 4,328,625 A | * | 5/1982 | Carella | 33/265 |

(Continued)

FOREIGN PATENT DOCUMENTS

| | | |
|---|---|---|
| WO | WO 97/32175 | 9/1997 |

OTHER PUBLICATIONS

Savage Systems, Inc. product catalog; 2000; Oak Grove, Louisiana; pp. 1-12.

(Continued)

*Primary Examiner*—Christopher W Fulton
(74) *Attorney, Agent, or Firm*—Morriss O'Bryant Compagni

(57) ABSTRACT

A bow sight is comprised of at least two support structures, at least one of the support structures supporting at least one angled sight pin. Each support structure is adjustably attached to a mounting member that allows individual vertical adjustment of each support structure and thus individual vertical adjustment of each sight point of the sight pins.

26 Claims, 11 Drawing Sheets

U.S. PATENT DOCUMENTS

| | | | | | |
|---|---|---|---|---|---|
| 4,418,479 | A | | 12/1983 | Stachnik | |
| 4,541,179 | A | | 9/1985 | Closson | |
| 4,819,611 | A | * | 4/1989 | Sappington | 33/265 |
| 4,884,347 | A | | 12/1989 | Larson | |
| 4,928,394 | A | | 5/1990 | Sherman | |
| 4,977,678 | A | | 12/1990 | Sears | |
| 5,086,567 | A | | 2/1992 | Tutsch | |
| 5,103,568 | A | | 4/1992 | Canoy | |
| 5,131,153 | A | | 7/1992 | Seales | |
| 5,174,269 | A | | 12/1992 | Sappington | |
| 5,231,765 | A | | 8/1993 | Sherman | |
| 5,285,767 | A | | 2/1994 | Padilla | |
| 5,362,046 | A | | 11/1994 | Sims | |
| 5,367,780 | A | | 11/1994 | Savage | |
| 5,383,279 | A | | 1/1995 | Tami | |
| 5,406,712 | A | * | 4/1995 | Slates | 33/265 |
| 5,419,051 | A | * | 5/1995 | Barngrover | 33/265 |
| 5,435,068 | A | * | 7/1995 | Thames et al. | 33/265 |
| 5,442,861 | A | | 8/1995 | Lorocco | |
| 5,442,863 | A | | 8/1995 | Fazely | |
| 5,517,979 | A | | 5/1996 | Closson | |
| 5,560,113 | A | | 10/1996 | Simo et al. | |
| 5,579,752 | A | | 12/1996 | Nelson et al. | |
| 5,619,801 | A | | 4/1997 | Slates | |
| 5,630,279 | A | * | 5/1997 | Slates | 33/265 |
| 5,632,091 | A | | 5/1997 | Brion et al. | |
| 5,634,278 | A | | 6/1997 | London | |
| 5,638,604 | A | | 6/1997 | Lorocco | |
| 5,644,849 | A | | 7/1997 | Slates | |
| 5,653,217 | A | | 8/1997 | Keller | |
| 5,671,724 | A | * | 9/1997 | Priebe | 124/87 |
| 5,676,122 | A | | 10/1997 | Wiseby et al. | |
| 5,685,081 | A | | 11/1997 | Winegar | |
| 5,718,215 | A | | 2/1998 | Kenny et al. | |
| 5,836,294 | A | | 11/1998 | Merritt | |
| 5,862,603 | A | | 1/1999 | Ellig | |
| 5,956,854 | A | | 9/1999 | Lorocco | |
| 6,000,141 | A | | 12/1999 | Afshari | |
| 6,016,608 | A | | 1/2000 | Lorocco | |
| 6,061,919 | A | | 5/2000 | Reichert | |
| 6,119,672 | A | | 9/2000 | Closson | |
| 6,122,833 | A | | 9/2000 | Lorocco | |
| 6,145,208 | A | | 11/2000 | Savage | |
| 6,216,352 | B1 | | 4/2001 | Lorocco | |
| 6,276,068 | B1 | | 8/2001 | Sheliga | |
| 6,311,405 | B1 | * | 11/2001 | Slates | 33/265 |
| 6,360,472 | B1 | | 3/2002 | Lorocco | |
| 6,382,201 | B1 | | 5/2002 | McPherson et al. | |
| 6,418,633 | B1 | | 7/2002 | Rager | |
| 6,421,946 | B1 | | 7/2002 | LoRocco | |
| 6,477,778 | B1 | | 11/2002 | Lorocco | |
| 6,494,604 | B2 | | 12/2002 | Khoshnood | |
| 6,539,637 | B1 | * | 4/2003 | Hollabaugh | 33/265 |
| 6,560,884 | B1 | | 5/2003 | Afshari | |
| 6,601,308 | B2 | | 8/2003 | Khoshnood | |
| 6,634,110 | B2 | | 10/2003 | Johnson | |
| 6,634,111 | B2 | | 10/2003 | LoRocco | |
| 6,725,854 | B1 | | 4/2004 | Afshari | |
| 6,796,039 | B2 | | 9/2004 | Walbrink | |
| 2002/0042999 | A1 | | 4/2002 | Lorocco | |
| 2002/0073559 | A1 | * | 6/2002 | Johnson | 33/265 |
| 2003/0208916 | A1 | | 11/2003 | Roger | |
| 2004/0006879 | A1 | | 1/2004 | Afshari | |
| 2004/0088871 | A1 | | 5/2004 | Afshari | |
| 2004/0111900 | A1 | * | 6/2004 | Rager | 33/265 |
| 2005/0246909 | A1 | * | 11/2005 | Rager | 33/265 |

OTHER PUBLICATIONS

Trophy Ridge product catalog; 2003; Belgrade, Montana; pp. 1-11.
Trophy Ridge product catalog; 2004; Belgrade, Montana pp. 1-16.
Scout Mountain Equipment product catalog; Pocatello, Idaho; 1996; pp. 1-7.
Jennifer Pillath; Bass Pro Shops Outdoor World, vol. 1-Issue 1; Sep. 2002.
Larry D. Jones; Bowhunter; Aug./Sep. 2002, pp. 18, 46 and unknown.
Bill Krenz; Better Hunting Sights; Bowhunter; Oct./Nov. 2002 (unknown page).
Mike Strandlund; Tackle & Technique A Better Way to Aim; Bowhunting World; Jun. 2002; p. 70.
Taming Bow Torque; Bowhunting World; Aug. 2002; pp. 91-92.
Guns & Gear; Jun. 2002; Introducing New Extreme Gear.
Richard Combs; Bow Sights 2002; Archery Business; Mar./Apr. 2002; pp. 54-56 and 66.
Truglo Product Catalog; 2001; pp. 1-20; McKinney, Texas.
Whitetail Bowhunter; AMO Uniting the Industry; 2001; pp. 87, 96 and unknown.
Cabela's catalog; date unknown; p. 803.
Bill Krenz; Trophy Ridge Mantis and Vdrive Sights; Inside Archery; Feb. 2004; pp. 92, 52 and unknown.
Bill Krenz; Five Star Bow Report; Bowhunt America; Feb./Mar. 2004; pp. 50, 61 and unknown.
Bill Krenz; Which Sights Should You Sell? and Vital Bow Gear Trapper and Star Track Sights; Inside Archery; Jun. 2004; pp. 54-56, 62-63, 68, 76.
Richard Combs; Bow Sights 2002; Archery Business; Mar./Apr. 2002; pp. 54-59.
Bow Masters; Feb. 2002; pp. 16, 23 unknown.
Bow Masters; Buyer's Guide; Aug. 2002; p. 45.
Cabela's Archery catalog; 2004; pp. 60-61, 65.
Cobra Manufacturing Co., Inc. website printout; Cobra Accessories; 2004; pp. 1-3.
Cobra Manufacturing Co., Inc. website printout; Cobra Scopes; 2004; pp. 1-2.
Cobra Manufacturing Co., Inc. website printout; Cobra Signature Scopes; 2004; pp. 1-2.
Sight Master website printout 2003; Townsend, Montana; pp. 1-6.
Carbon Impact product catalog; 1999; Traverse City, Missouri; pp. 1-8.
Trophy Ridge product catalog; 2005; Belgrade, Montana; pp. 1-15.
Rocket Aeroheads by Trophy Ridge product catalog; 2005; Belgrade, Montana; pp. 1-8.
Toxonics Manufacturing, Inc. sight photographs; date unknown; Wentzville, Montana; pp. 1-7.
Majestic Hunter Bow Sight by Altier Archery, Mfg. photographs; date unknown; Honesdale, Pennsylvania; pp. 1-6.

* cited by examiner

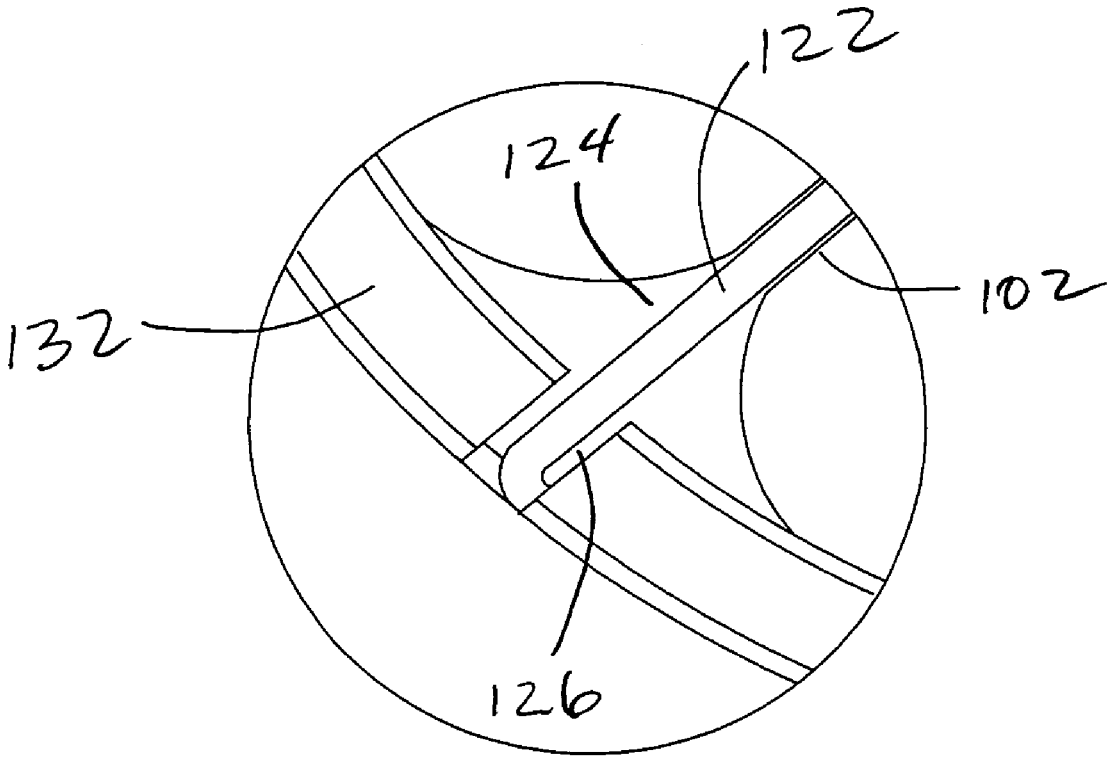
DETAIL A

BOW SIGHT WITH ANGLED PINS

CROSS-REFERENCE TO RELATED APPLICATIONS

This application is a continuation-in-part of and claims priority to U.S. patent application Ser. No. 11/079,004, filed Mar. 11, 2005, now U.S. Pat. No. 7,200,943, which is a continuation of U.S. patent application Ser. No. 10/435,943, filed May 12, 2003, now U.S. Pat. No. 6,938,349. which was a continuation-in-part of U.S. patent application Ser. No. 09/989,935, filed Nov. 20, 2001, now U.S. Pat. No. 6,560, 884, which was a continuation-in-part of U.S. patent application Ser. No. 09/991,243, filed Nov. 20, 2001, now U.S. Pat. No. 6,725,854.

BACKGROUND OF THE INVENTION

1. Field of the Invention

This invention relates generally to sights for archery bows and, more specifically, to bow sights having sight pin constructions that are angularly oriented.

2. Description of the Art

Archery bow sights utilizing a plurality of sight pins have been known in the art for many years. Typically, these sights use a bracket or other mounting structure for mounting the sight to a bow. The sight is commonly comprised of a pin plate, a pin guard, and a plurality of sight pins which are secured to the pin plate and extend into a sight window formed by the pin guard. The sight is mounted to a bow in a manner so that when the bow string is drawn, the archer can look through a peep sight provided in the bow string and align the tip of a pin attached to the sight with a target. For sights utilizing a plurality of horizontally extending sight pins having their tips vertically aligned, each individual sight pin is typically provided for aiming the bow at a target at a particular distance from the archer. For example, one pin may be positioned in the sight for aiming the bow at a target 50 yards from the archer while another pin may be positioned for a target that is at 70 yards distance.

One such example of a bow sight is sold by Vital Bow Gear of Pocatello, Id. The bow sight is comprised of a pin plate, a pin guard and a sight window formed therebetween. A plurality of horizontally oriented sight pins are secured to the pin plate by screws, which engage the sight pins and extend through a slot formed in the pin plate. The sight pins extend transversely from the pin plate into the sight window. The bow sight is attached to various mounting brackets for attachment to the riser of a bow.

In use, the archer typically aligns a peep sight positioned on or formed in the bowstring with one of the sight pins 20. In order to properly sight in the sight to the bow (i.e., properly adjust sight pin to a particular distance from the target), each of the sight pins 20 is individually positioned and adjusted to correspond to a given distance (e.g., 20 yards, 40 yards, 60 yards, etc.) from the bow 12. The sight pins 20 allow the archer to better position the aim of the arrow to compensate for target distance and trajectory. Thus, the archer estimates his or her distance from a specific target (e.g., 20 yards) and utilizes the particular sight pin for that distance.

Some bow sights provide a single sight pin, as for use in target practice where the distance from the target does not change or in a tree stand scenario where bate is left at a particular distance from the hunter. Such single pin bow sights are incorporated into a pendulum arrangement and are commonly referred to as pendulum sights. Such pendulum sights are often used in conjunction with tree stands and the like where the hunter is positioned above the target and is aiming in a severely downward direction at the ground to animals below the hunter. In such a situation, the distance to target, while not fixed, is usually within a small range thus suited for a single pin sight arrangement.

One of the concerns of multiple pin bow sights that use horizontally oriented sight pins is that each sight pin that extends into the sight window provides a visual obstruction of the target. Thus, prior art sight pins have been designed to be relatively thin when viewed in the direction of aiming so as to produce the smallest visual obstruction possible.

One way of reducing the visual obstruction to the user is disclosed in copending patent application serial number U.S. patent application Ser. No. 09/989,935, now U.S. Pat. No. 6,560,884, herein incorporated by reference. In this patent, a single vertical sight pin includes multiple sight points. As such, a single vertical sight pin provides multiple sighting points while limiting visual obstruction to a single sight pin.

In copending U.S. patent application Ser. No. 09/991,243, herein incorporated by reference, a bow sight providing a single vertical sight pin is disclosed.

In U.S. Pat. No. 6,418,633 to Christopher A. Rager, a bow sight is provided with two or more vertically aligned vertical pins connected to the support structure. Each pin is provided with a different height, with the shortest pin positioned nearest the archer's eye so as to provide multiple visible sight tips when viewed by the archer when aiming the sight at a target. Each sight pin is vertically adjustable relative to the support structure so as to allow sighting of each sight pin for a particular distance-to-target. Because of the relative size of such sight pins, however, accurate adjustment of the height of such pins is difficult if not impossible.

The bow sight described in the above-referenced copending patent application hereto includes vertically aligned pins that are independently vertically adjustable. This bow sight is configured with each sight pin positioned in front or behind an adjacent pin. While reducing the obstruction of view by reducing the overall surface area of the pins that are visible to the archer, one of the drawbacks of this type of pin arrangement is that visually, the archer tends to focus on the entire length of the sight pin rather on the sigh point alone. That is, because the sight pins are vertically arranged, the body of the sight pin itself often becomes a distraction when aiming.

Thus, it would be desirable, to provide a bow sight that provides a multiple pin arrangement where the pins are neither uniformly vertically arranged nor uniformly horizontally arranged.

SUMMARY OF THE INVENTION

Accordingly, a bow sight is comprised of one or more support structures for supporting at least one angled sight pin. In one embodiment, each sight pin is attached to a respective support structure and each support structure defines a sight window with the respective sight pin angularly oriented within the sight window. The plurality of support structures that comprise single bow sight each provide respective sight pins of varying length, but are configured when stacked to vertically align each sight point within the sight window so that when viewed in an aiming direction, only a portion of each sight pin is visible to the archer.

In one embodiment of the invention, the base portions of each sight pin are similarly positioned such that the base portions appear to positioned one in front of the other. Thus, the full front of the closest sight pin is visible and the remaining sight pins have portions extending from behind the first sight pin, each terminating at its respective sight point.

Each support structure is configured for attachment to and adjustment bracket that allows for individual vertical adjustment of each support structure. Because the sight pins are fixedly attached to their respective support structures, adjustment of the sight pins themselves is eliminated.

In one embodiment of the present invention the sight pins are integrally formed with their respective support structure.

In another embodiment, the support structures are generally cylindrical in shape.

In yet another embodiment, each sight tip of each sight pin is illuminated utilizing a segment of fiber optic material.

In still another embodiment, the fiber optic segment is wrapped at least partially around the exterior of its respective support structure so as to provide additional exposed surface area for gathering light.

In yet another embodiment, the support structure closest to the archer is covered with a high visibility material to make the front surface of the support structure more visible to the archer in low light conditions.

In still another embodiment, a channel is formed around the exterior of each support structure for containing a segment of luminescent material with a length of fiber optic material used for forming the sight tip of the sight pin disposed over the luminescent material.

In still another embodiment, a dampening material is disposed between each of the stacked support structures to prevent sound generation between adjacent rings that may be caused by vibrations in the bow while shooting.

The difference in angle between each adjacent sight pin may be calculated using conventional ballistic formulas in order to provide a distance between sight points for a particular speed of bow. Such formulas can be found in an article entitled "Exterior Ballistics of Bows and Arrows" by W. J. Rheingans, herein incorporated by this reference. Thus, a set of support structure/sight pins can be provided for a particular bow speed and typical distances as a base point. To accommodate bows of different bow speeds or to adjust each sight pin for a different distance-to-target, however, the individual support structures can be independently vertically adjusted.

Of course, the sight pins of the present invention may be integrally formed with their respective support structure or may be a separate component that is mechanically attached to the support structure.

Figure 2A:
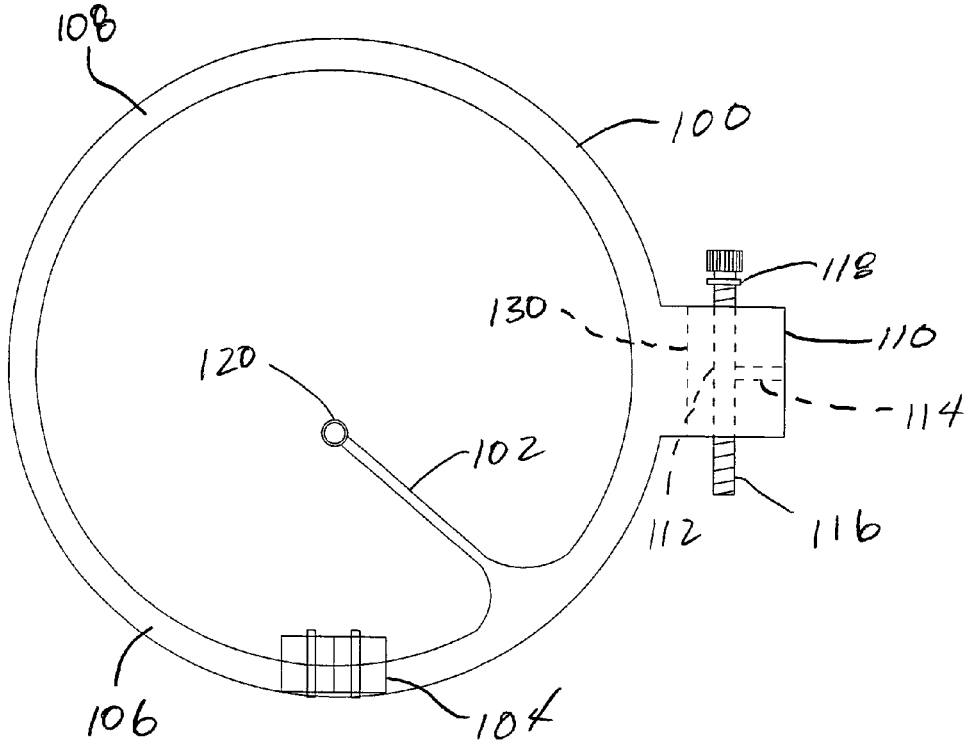
FIG. 2A is a front view of a sight pin/support structure in accordance with the principles of the present invention.
Figure 2B:
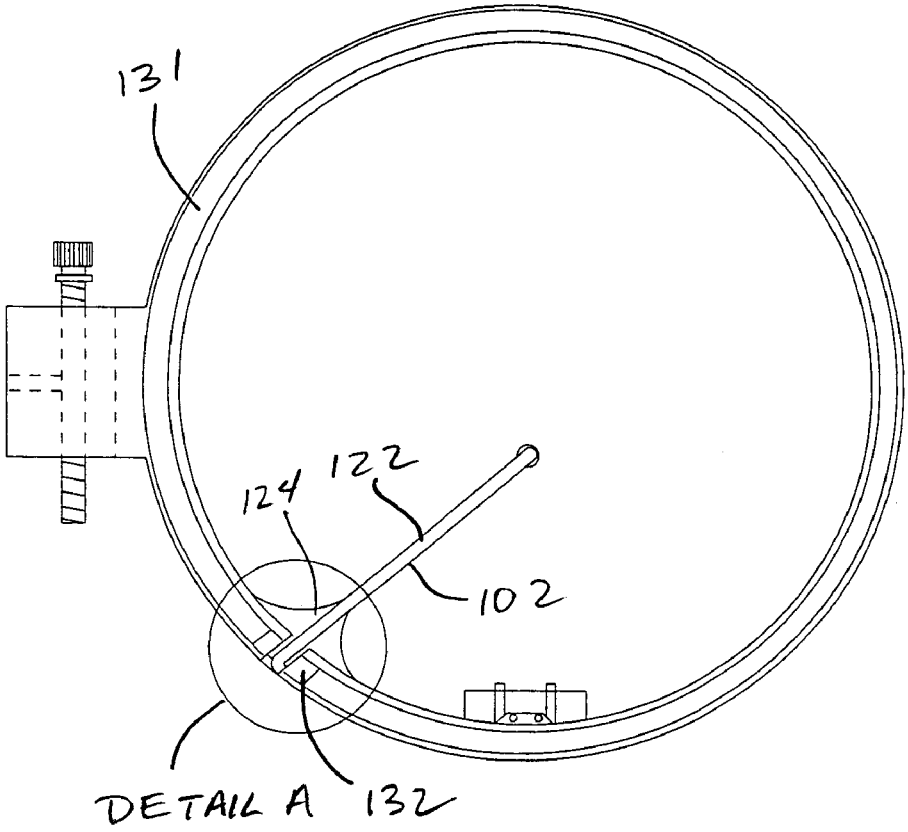
FIG. 2B is a back view of the sight pin/support structure illustrated in FIG. 2A.
Figure 2C:
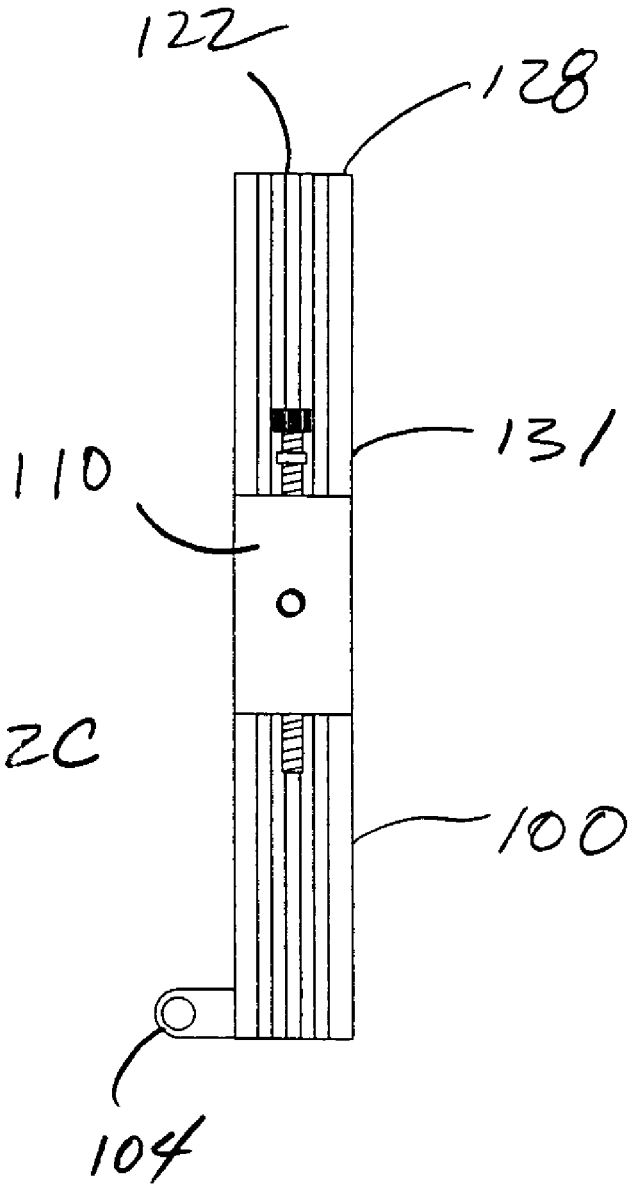
Figure 3:
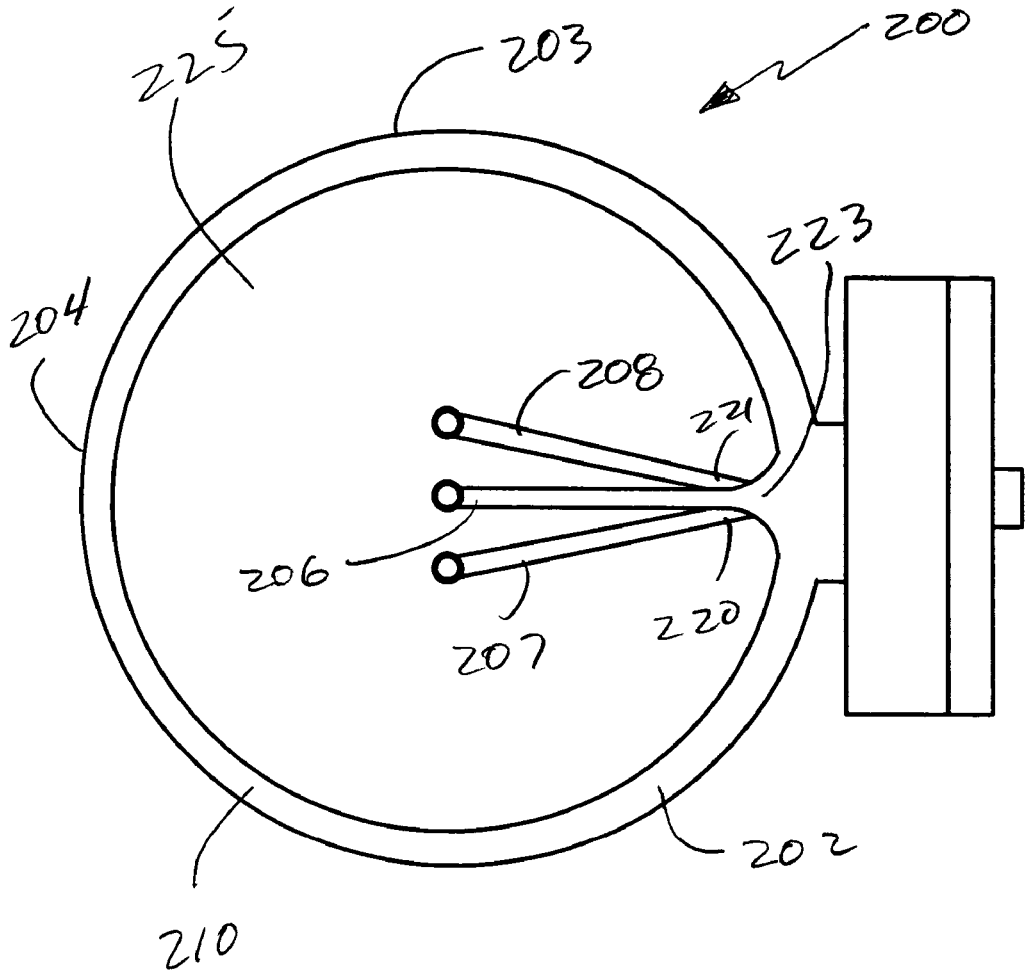
Figure 4:
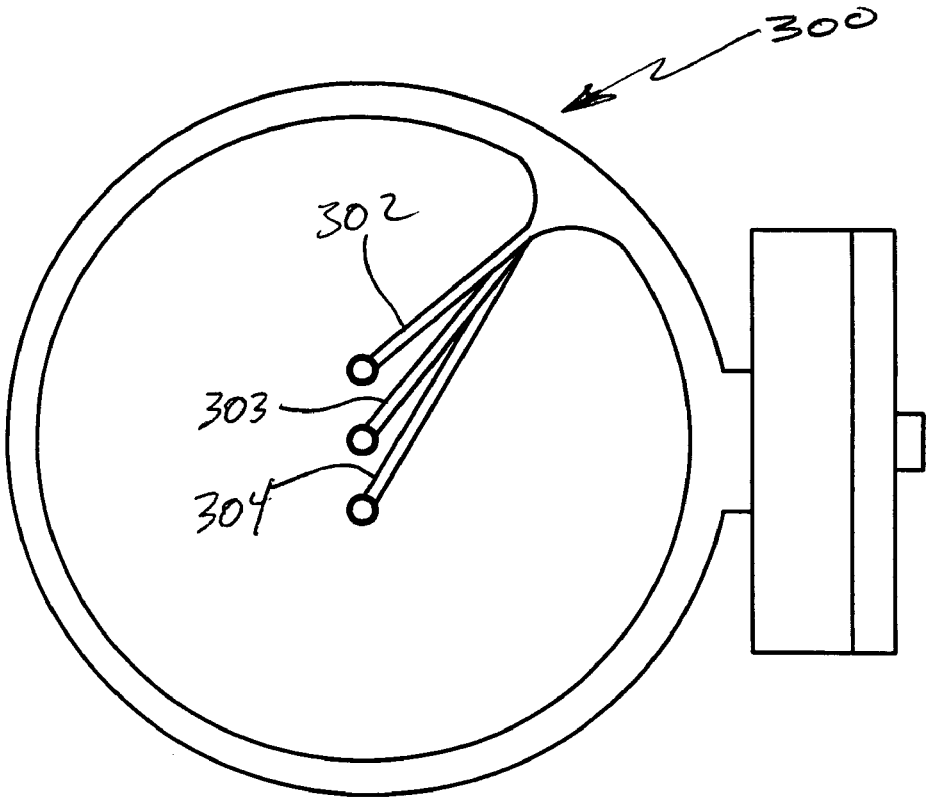
Figure 5:
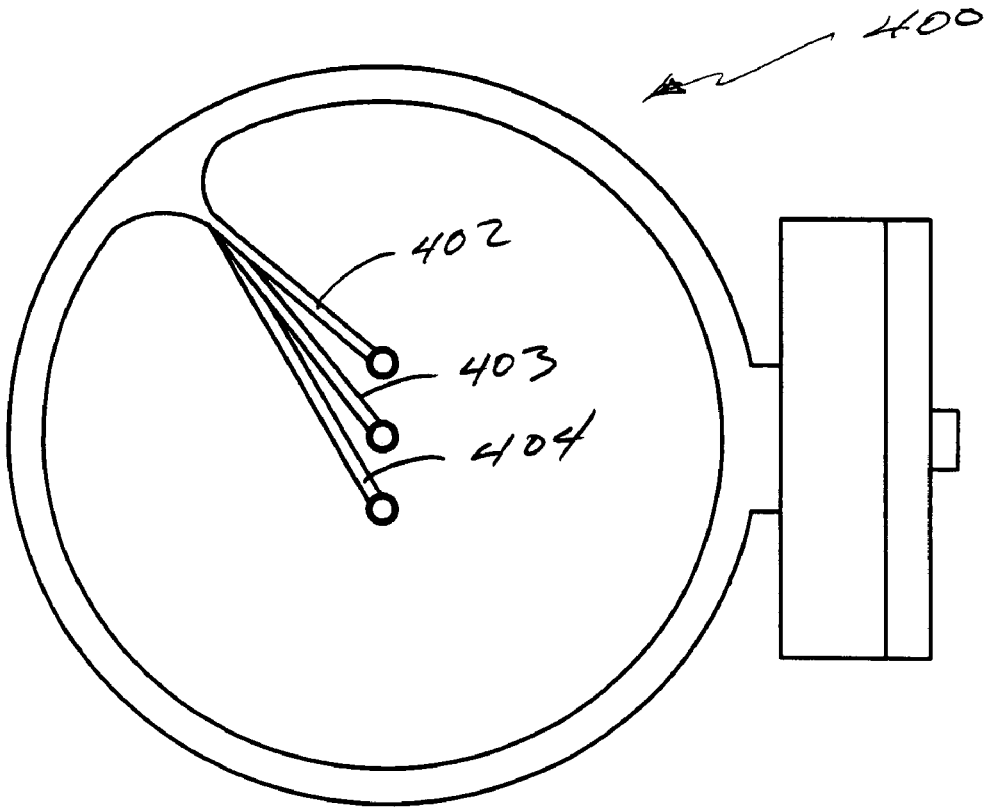
Figure 6:
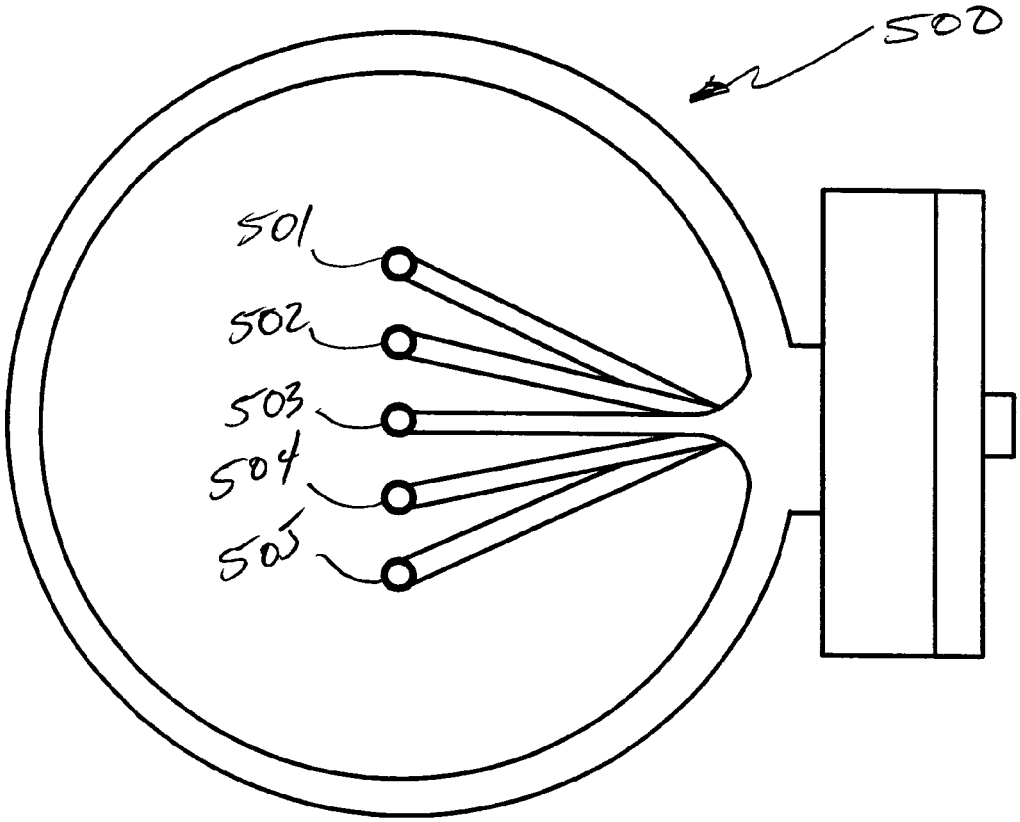
Figure 7:
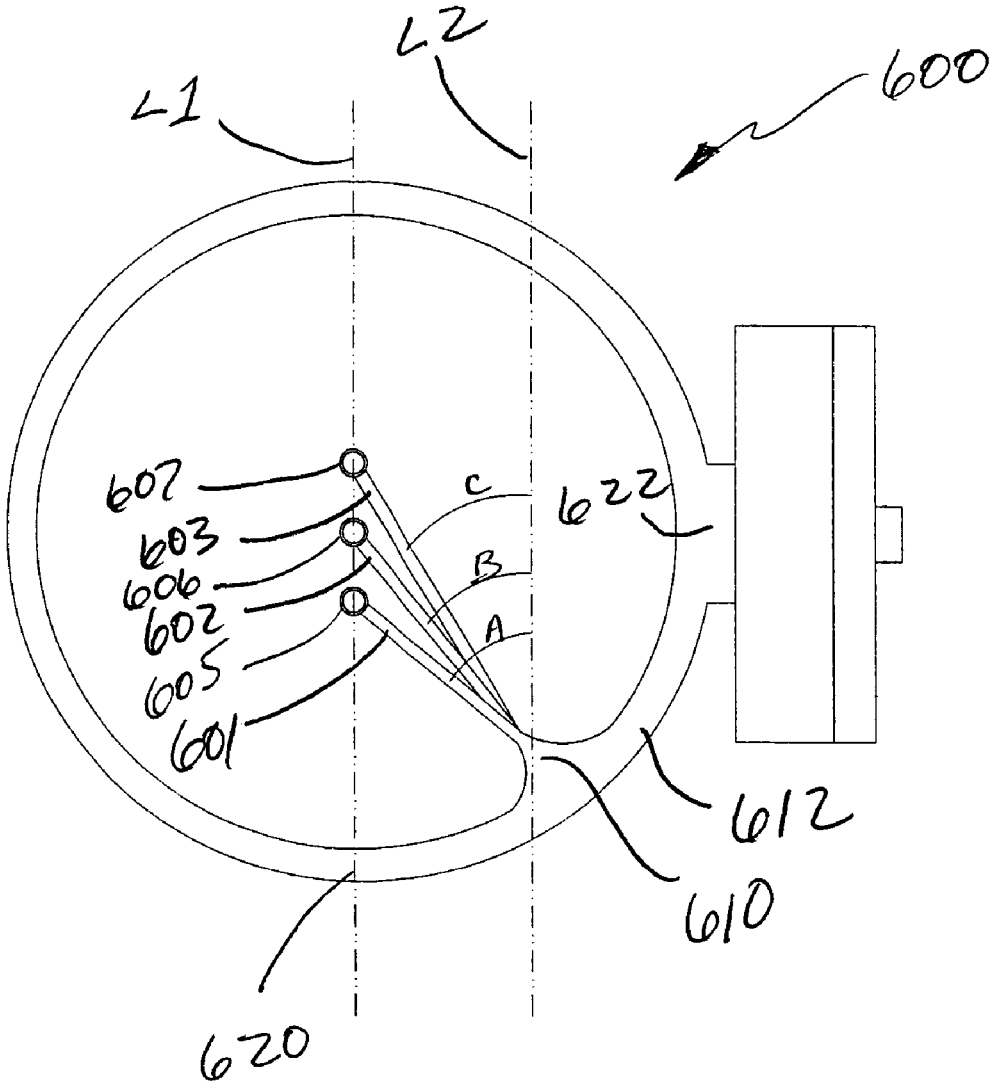
Figure 8A:
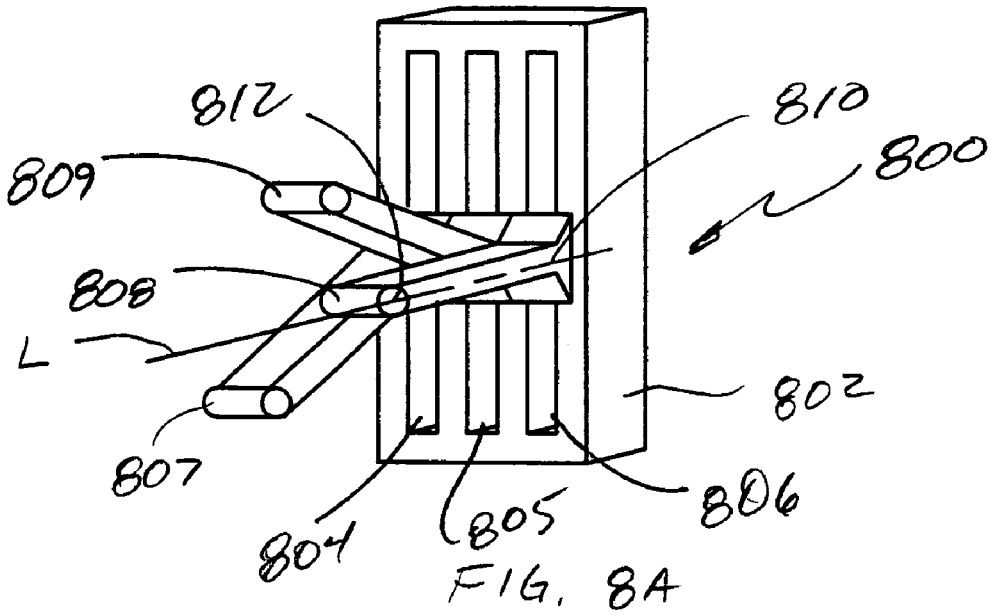
Figure 8B:
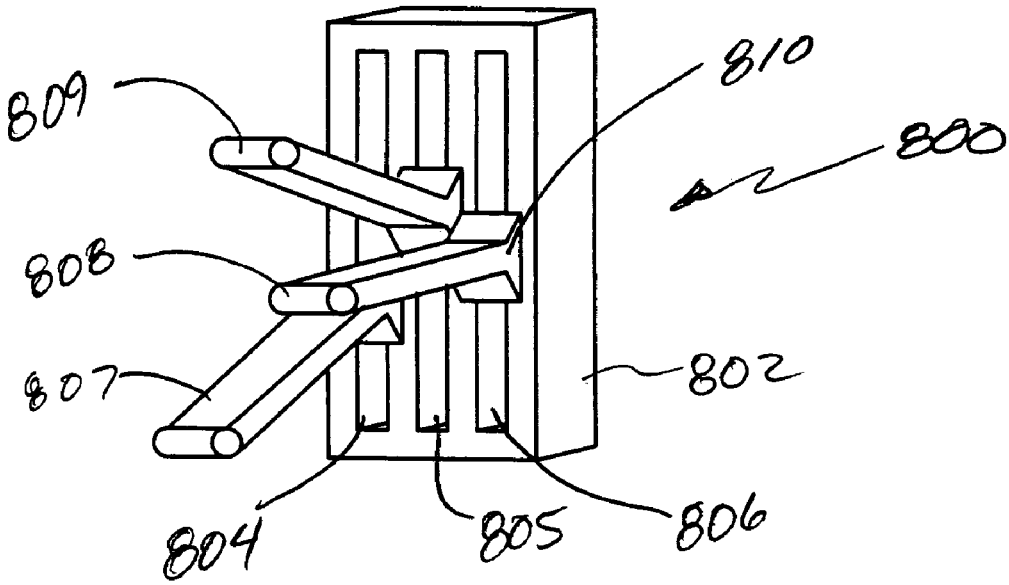

DETAIL A is a close-up detail of FIG. 2B;

FIG. 2C is a side view of the sight pin/support structure illustrated in FIG. 2A;

FIG. 3 is a front view of a second embodiment of a bow sight in accordance with the principles of the present invention;

FIG. 4 is a front view of a third embodiment of a bow sight in accordance with the principles of the present invention;

FIG. 5 is a front view of a fourth embodiment of a bow sight in accordance with the principles of the present invention;

FIG. 6 is a front view of a fifth embodiment of a bow sight in accordance with the principles of the present invention;

FIG. 7 is a front view of a sixth embodiment of a bow sight in accordance with the principles of the present invention; and FIGS. 8A and 8B are perspective front views of a seventh embodiment of a bow sight in accordance with the principles of the present invention.

DETAILED DESCRIPTION OF THE INVENTION

Figure 1A:
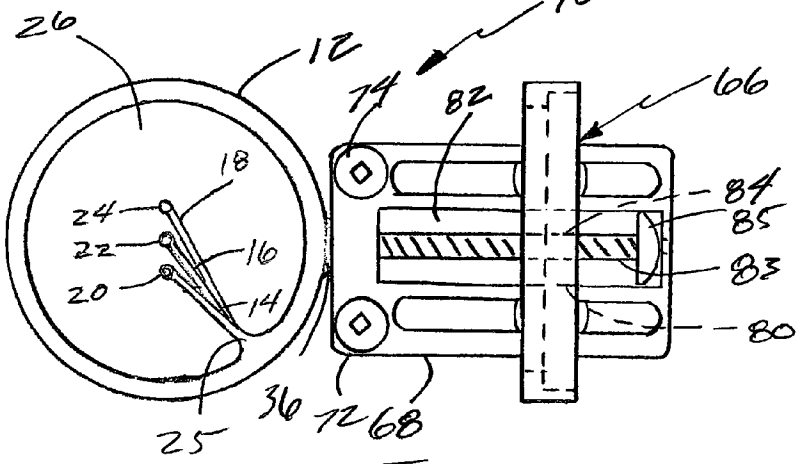
FIG. 1A is a front view of a first embodiment of a bow sight in accordance with the principles of the present invention showing the bow sight when viewed by an archer in a shooting position.

FIG. 1A illustrates a multiple pin bow sight, generally indicated at 10 in accordance with the principles of the present invention. The sight 10 is comprised of a plurality of support structures (only one of which is visible) 12 or rings which define pin guards, each of which support a sight pin 14, 16 and 18. Each sight pin 14, 16, and 18 is provided with sighting indicia or a sight tip 20, 22 and 24, respectively. The sight pins 14, 16 and 18 are angularly oriented when viewed by an archer in a shooting position as shown in FIG. 1A. That is, while at least a portion of each sight pin 14, 16 and 18 is visible, the base portions 25 of each sight pin 14, 16 and 18 are aligned when viewed as shown in FIG. 1A. Thus, each of the sight pins 16 and 18 are positioned behind the sight pin 14, with the base of each sight pin 14, 16 and 18 originating from substantially the same visual point and the sight tips 20, 22 and 24 being vertically aligned while being vertically spaced with the length of each sight pin 14, 16 and 18 visually splayed apart.

Thus, the sight pins 16 and 18 only have portions visible that include their respective sight tips 22 and 24 for viewing by the archer when aiming. In addition, by angling the sight pins into the sight window 26, the archer can see a target between the sight tips 20, 22 and 24. This is not always possible with bow sights where the pins are vertically aligned. Especially for small targets, it is easer to maintain a respective sight tip 20, 22 or 24 on a target when the target can be seen when positioned slightly below or above the particular sight tip 20, 22 or 24. The bow sight 10 of the present invention allows for visual spacing between the sight tips 20, 22 and 24 such that a target can be seen between the sight tips 20, 22 and 24. This is also helpful in what is referred to as "gap shooting." That is, when the sight tips 20, 22 and 24 are each set for a particular distance-to-target, it is sometimes the case that the actual distance to target is between two pins. With the bow sight 10 of the present invention, the archer can position the target between two sight tips to adjust to a distance that is between the distances for those respective sight tips.

With the base portions 25 of each sight pins 20, 22 and 24 originating from substantially the same visual position of each respective support structure 12, the amount of space in the sight window 26 defined by the pin guard 12 that is occupied by the bodies of the pins 14, 16 and 18 is minimized.

As shown, the sight pin 14 may be integrally formed with the support structure or pin guard 12 or may be formed from separate components attached together in various fashions. For example, as previously discussed herein, it is known in the art to provide a pin plate for supporting the sight pin with a pin guard, which protects the sight pin, attached to the pin plate. A similar arrangement could be readily adapted to result in a similarly constructed bow sight comprised of separately attached components to achieve the same general structure.

Figure 1B:
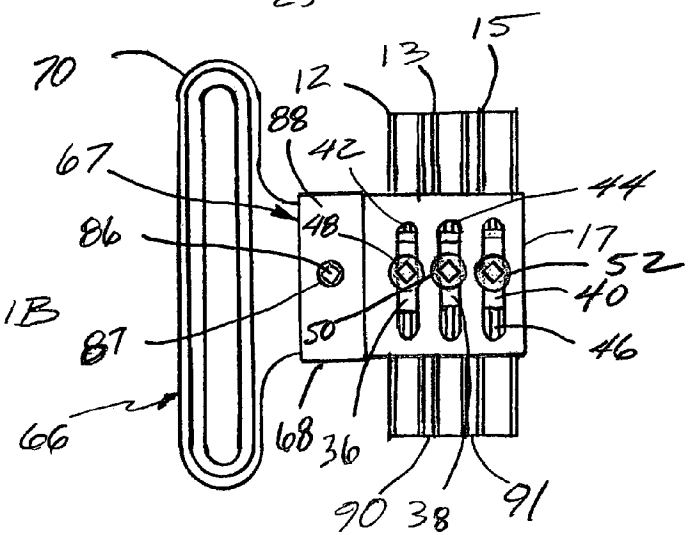
FIG. 1B is a side view of the bow sight illustrated in FIG. 1A.
Figure 1C:
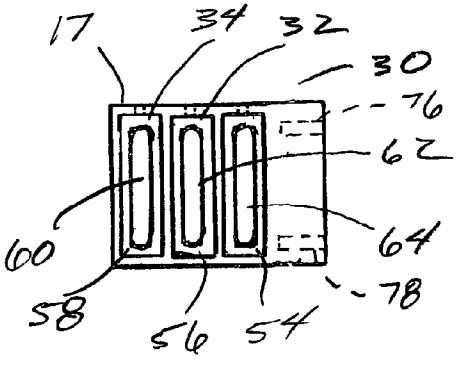
FIG. 1C is a side view of the adjustment bracket illustrated in FIG. 2B.

As shown in FIGS. 1B and 1C, each support structure 12, 13 and 15 is individually vertically adjustable relative to an adjustment bracket 17. The adjustment bracket 17 is provided with three elongate channels 30, 32 and 34, each of which is configured for receiving therein a mounting portion 36, 38 and 40, respectively, of the support structures 12, 13 and 15. Each mounting portion 36, 38 and 40 is generally rectangular in cross-section having a width that is slightly smaller than the width of its respective channel and a depth that is at least slightly larger than the depth of its respective channel. Thus, the mounting portions 36, 38 and 40 can be moved vertically within the adjustment bracket 17 but are prevented from rotating or tilting because of the abutting engagement with the channel.

Each mounting portion 36, 38 and 40 is threadedly engaged by an adjustment screw 42, 44 and 46, respectively, that extends the length of its respective channels 30, 32 and 34. Securing fasteners 48, 50 and 52 hold the respective mounting portions 36, 38 and 40 to the adjustment bracket 40 by threadedly engaging the mounting portions and holding the mounting portions against the inside surfaces 54, 56 and 58 of the channels 30, 32, and 34, respectively. The slots 60, 62 and 64 allow the securing fasteners 48, 50 and 52 to engage the adjustment bracket 17 over a range of positions to allow for vertical adjustment of the sight pins 14, 16 and 18.

The adjustment bracket 17 is further coupled to a windage adjustment mechanism 66 shown in FIGS. 1A and 1B. The windage adjustment mechanism provides for horizontal gang adjustment of the adjustment bracket 17 and associated support structures 12, 13 and 15. The windage adjustment mechanism 66 is comprised of two brackets including a second adjustment bracket 68 and a bow mounting bracket 70 for attaching to the riser of a bow (not shown). The second adjustment bracket 68 is mounted to the first adjustment bracket 17 with threaded fasteners 72 and 74 into threaded bores 76 and 78. The bow mounting bracket 70 is attached to the second adjustment bracket 68 in a similar fashion to the support structures 12, 13 and 15 are mounted to the first adjustment bracket 68. That is, the bow mounting bracket 70 includes a mounting portion 80 that fits within an elongate slot 82 formed in the second adjustment bracket 68. A threaded fastener 83 engages a threaded bore 84 that extends transversely through the mounting portion 80. The fastener 83 has a length that is only slightly smaller than the length of the channel 82 so as to substantially prevent movement of the fastener 83 in the direction of its longitudinal axis. The mounting portion 80 of the bracket 70 prevents substantial movement of the fastener 83 in a direction transverse to its longitudinal length. The head 85 of the fastener 83, and more particularly, the engaging feature 86 (in this example a square hole, but may also include hex head openings and the like) of the fastener 83 is engageable through a hole or bore 87 provided in the side 88 of the bracket 68. By rotating the fastener 83 with a tool (not shown) inserted through the opening 87, the bracket 70 is controllably moved relative to the adjustment bracket 68. When the bracket 70 is mounted to a bow, rotation of the fastener 83 causes a corresponding horizontal displacement of the sight 10 relative to the bow. Thus, the adjustment brackets 17, 68 and/or the windage adjustment mechanism 66 form a mounting structure, generally indicated at 67.

As shown in FIG. 1B, interposed between each support structure 12, 13 and 15 are vibration dampeners 90 and 91 that prevent the support structures 12, 13 and 15 from impacting one another due to vibration incurred when the bow is fired. The dampeners 90 and 91 effectively allow the separate support structures 12, 13 and 15 to be placed closely together to provide a relatively compact bow sight 10, while eliminating noise that may otherwise be generated if the support structures 12, 13 and 15 were allowed to vibrate against one another. Also, the dampeners 90 and 91 are essentially sandwiched between adjacent support structures 12, 13 and 15 to cause the individual support structures 12, 13 and 15 to essentially act as a single unit while still allowing for individual adjustment of the support structures 12, 13, and 15. Each dampener 90 and 91 is attached to one of the support structures so that during adjustment of the support structures 12, 13 and 15, the dampeners stay in place relative to at least one of the support structures 12, 13 and 15. By sandwiching the dampeners 90 and 91 between the support structures 12, 13 and 15 with no gaps between the support structures and the dampeners, vibrational noise between the dampeners and the support structures is also eliminated. When utilizing circular support structures as illustrated, the dampeners may be comprised of o-rings of a similar diameter or sections of o-ring material.

Referring now to FIG. 2A, there is illustrated one support ring 100 and associated sight pin 102 in accordance with the principles of the present invention. The support ring/sight pin assembly may be the ring/sight pin assembly closest to the archer when utilizing the sight with other rings in a manner illustrated in FIG. 1A. A bubble-type leveling device 104 is attached to the front surface 106 of the support ring 100 to provide a visual leveling guide for the user to ensure that the sight is as near level as possible when shooting. The front surface 106 is at least partially covered with a high visibility material or paint 108 so as to provide the user with a easily visible sight window 110, even in low light conditions. For example, the material or paint 108 may include an elongate strip of florescent or glow-in-the-dark tape.

As previously discussed, the mounting portion or tab 110 is generally rectangular in cross section and length and is provided with a pair of threaded bores 112 and 114. The bore 112 extends transversely through the tab 110 for engaging with an adjustment screw 116 for vertical adjustment of the tab 110 relative to an adjustment bracket as illustrated in FIG. 1C. A dampener 118 in the form of an o-ring is positioned on the fastener and has a diameter that is slightly larger than the channel of the mounting bracket in which it is inserted to reduce vibration of the fastener 116 and or tab 110 within the channel. The second bore 114 is provided for securing the tab 110 to the adjustment bracket once the desired position of the tab 110 within the channel is obtained.

The sight pin 102 is provided with a fiber optic member which forms a sighting indicia or tip 120 at one of its terminal ends. As shown in FIG. 2B, the fiber optic member 122 (formed from an elongate plastic strand that may be colored with a desired color such as yellow, green, red, orange or the like), and as better shown in DETAIL A, extends along the back 124 of the sight pin 102. A slot 126 is provided at the base of the sight pin 102 to allow the fiber optic member 122 to be bent at least 90 degrees for wrapping around the exterior of the support structure 100.

As shown in FIG. 2C, to accommodate the fiber optic member 122, a channel 128 circumscribes the support ring 100 around its outer surface. The fiber optic member 122 is wrapped several times in the channel 128. A length of glow-in-the-dark tape or material may be placed beneath the fiber optic wrappings to help illuminate the sight tip 120 in low light conditions. The fiber optic wrappings pass through a transversely extending opening 130 (FIG. 2A) to allow the wrappings to pass through the tab 110. The fiber optic wrappings pass through a transversely extending opening to allow the wrappings to pass through the tab 110.

A dampening member 131 is adhesively attached to the support structure 100 and is partially inserted within a small channel 132 formed in the back surface of the support ring 100. The dampening member 131 partially encircles the support ring 100 to provide its dampening function over a substantial portion of the support ring 100.

Referring now to FIG. 3, there is shown yet another embodiment of a bow sight, generally indicated at 200 in accordance with the principles of the present invention. The sight 200 is comprised of a pair of three support structures 202, 203 and 204 (only 202 of which is visible) which support three sight pins 206, 207 and 208, respectively. The support structures 202 and 204 have similar diameters so as to present a single prominent surface 210 when viewed as shown in FIG. 3. The sight pin 206 is horizontally oriented while the sight pins 207 and 208 are angled relative to the sight pin 206. The sight pins 207 and 208 have base portions 220 and 221, respectively, that originate from the same general location of the sight 200 as the base portion 223 of the sight pin 206 so as to minimize the visible portions of the sight pins 206, 207 and 208 in the sight window 225 defined by the support structure 204.

As shown in FIGS. 4, 5 and 6, the angled pin concepts of the present invention can be applied in any pin orientation. For example and not limitation, downwardly angled pins 302, 303 and 304 may extend from the top right portion of the sight 300 as shown in FIG. 4. Likewise, downwardly angled pins 402, 403 and 404 may extend from the top left portion of the sight 400. It is further contemplated as shown in FIG. 6, that the principles of the present invention may be applied to sights with any number e of sight pins, such as the five sight pins 501, 502, 503, 504, and 505 of the sight 500.

Referring now to FIG. 7, the bow sight 600 according to the present invention is provided with three angled sight pins 601, 602 and 603. Each sigh pin 601, 602 and 603 is provided with a sight point 605, 606 and 607, respectively. Each sight point 605, 606 and 607 is in substantial vertical alignment relative to a vertical line L1. As previously described with reference to other embodiments herein, each sight pin 601, 602, and 603 has a base 610 that is attached to the support structure 612 at the same position as the other sight pins. This is possible with the present invention because the sight pins 601, 602 and 603 are in a stacked arrangement. That is, the sight pins are positioned one in front of the other. In order for each sight point 605, 606 and 607 to lie along the same vertical line L1, the lengths of each sight pin vary accordingly such that the sight pin 601 is the shortest and the sight pin 603 is the longest. Each sight point 605, 606 and 607 can be independently vertically adjusted relative to the other sight points with the adjustment mechanism described herein.

Each sight pin 601, 602 and 603 also has its own angular orientation in order to properly position the sight points 605, 606 and 607 along the vertical line L1. That is, relative to vertical line L2, the longitudinal axis of the elongate sight pin 601 is angled more than the longitudinal axis of the elongate sight pin 602, which is angled more than the longitudinal axis of the sight pin 603. Depending upon the position of the base portion 610, the angles A, B and C of the sight pins 601, 602 and 603, respectively, may range from nearly vertical to nearly horizontal. As such, in general the angles A, B and C will range from between about 5 degrees to about 85 degrees. Where the sight pins 601, 602 and 603 are positioned as shown with the base 610 of the sight pin 601 positioned approximately midway between the bottom 620 of the support structure and the side 622 of the support structure 612 such that the center pin 602 is angle at approximately 45 degrees and for a bow shooting an arrow at approximately 260 ft/sec, the angle A would be approximately 58 degrees, the angle C would be approximately 40 degrees. Of course, changing the configuration of the supports structure, the position of the sight pins, etc. could necessarily change the angles A, B and C of the sight pins 601, 602 and 603.

It should be noted that each sight pin is provided with a single aiming structure, such as a bead or the exposed end of a fiber optic element, provided on the "tip" or "point" of the sight pin. The term sight tip or point is thus commonly used to refer to this part of the sight pin that is used as the aiming reference. Each of the sighting tips of their respective sight pins are vertically spaced relative to one another when viewed by an archer in a shooting position to provide the proper target or aiming reference for a particular distance-to-target. Thus, each of the sight tips represent a specific target distance (e.g., 20, 30, 40, 50 and 60 yards). Thus, while the present invention has been illustrated as having three or five ringed bow sights, additional ring/sight pin assemblies may be added to increase the number of sight pins for a given sight.

The bow sight pin/support structure assemblies of the present invention may be comprised of molded polycarbonate, machined aluminum components or any other lightweight materials known in the art. Thus, the sight may be formed from plastic, aluminum, or other materials known in the art and formed by various techniques known in the art. In addition, the pins and pin guard components may be separate components as previously described or integrally formed as by casting, molding or machining. Of course, those of skill in the art will appreciate that there may be other means and mechanisms of attaching the pins to the pin guard depending upon the configuration of the particular sight. Thus, by incorporating features of known bow sights and sight pins into the sight pin/pin guard arrangement of the present invention, the bow sight may take on various configurations. For example, it is not necessary for the pin guard to have a circular shape as there are numerous pin guard shapes known in the art that may be applied to the present invention. Moreover, while the present invention has been described with reference to the use of fiber optic elements, it is also contemplated that the sight indicia provided on each sight pin may by comprised of any material. For example, the sight pin may be formed from a brass element with the individual sight tips painted on the sight tip of the sight pin. Thus, it is not necessary to form the sight pin from any particular material so long as the sight tips or individual sighting indicia or indicators are separately visible by a user.

In addition, the principles of an angled pin of the present invention can be incorporated into any preexisting sight technology. For example, as shown in FIGS. 8A and 8B, the bow sight 800 includes a pin plate 802 defining a plurality of channels 804, 805 and 806 therein. Each channel 804, 805 and 806 includes a sight pin 807, 808 and 809, respectively, attached thereto in a manner that allows each sight pin 807, 808 and 809 to be independently vertically adjustable relative to the pin plate 802.

Each sight pin includes a base portion, such as base portion 810 of pin 808 coupled to the pin plate 802. Each sight pin also includes a sight point such as sight point 812. Each sight point of the sight pins 807, 808 and 809 are in substantial vertical alignment when viewed by an archer in a shooting position. In addition, each sight pin 807, 808 and 809 defines an effective longitudinal axis L that extends between the base portion 810 and the sight point 812. The effective longitudinal axis L for each sight pin has a from a from a vertical axis or line such as the vertical line that extending through each of the sight points.

As illustrated, each of the sight pins 807, 808 and 809 are independently vertically adjustable relative to the pin plate 802. In addition, as each pin is adjusted relative to the pin plate 802 as shown in FIG. 8B, the angle of each effective longitudinal axis L is maintained relative to the vertical axis when the sight pins 807, 808 and 809 are adjusted. The angle of each effective longitudinal axis L is between ninety, for sight pin 808 an about forty-five degrees for pins 809 and 807. Depending upon the desired spacing between the sight points at the "zero" position as shown in FIG. 8A with all of the base portions 810 being aligned, the angle could practically range from about 30 degrees to ninety degrees.

The configuration of the angled sight pins 809 and 807 relative to the horizontal sight point 808 allows for close spacing between the base portion 810 of the sight pins as well as tight spacing between the sight points 812 as desired. In addition, when the sight points 812 are spaced apart as shown in FIGS. 8A and 8B, the archer can see a target between the sight points 812 since none of the sight pins 807, 808 and 809 extend vertically. The bow sights according to the present invention are configured to be attached to virtually any pre-existing bow configuration known in the archery industry by providing appropriate mounting hardware.

Accordingly, while the present invention has been described with reference to certain embodiments to illustrate what is believed to be the best mode of the invention, it is contemplated that upon review of the present invention, those of skill in the art will appreciate that various modifications and combinations may be made to the present embodiments without departing from the spirit and scope of the invention as recited in the claims. The claims provided herein are intended to cover such modifications and combinations and all equivalents thereof. Reference herein to specific details of the illustrated embodiments is by way of example and not by way of limitation.

What is claimed is:

1. A bow sight, comprising:

at least one mounting structure;

a plurality of support structures coupled to said at least one mounting structure, each of said plurality of support structures being independently vertically adjustable relative to said at least one mounting structure, and each of said plurality of support structures defining a sight window, said plurality of support structures being positioned one behind the other when viewed in a shooting position; and a plurality of sight pins with at least one of said plurality of sight pins attached to each of said support structures and said plurality of sight pins each having a proximal end and defining a sight point at a distal end thereof within the sight window defined by the support structure to which such sight pin is attached and each of said plurality of sight pins having an angle relative to a vertical plane of between about five degrees and eighty-five degrees, the plurality of sight pins being stacked one behind the other when viewed in a shooting position, the proximal end of each of said plurality of sight pins visually originating from a common position relative to a front support structure of said plurality of support structures when viewed in a shooting position with each sight pin having a different angular orientation and each sight point of each of said plurality of sight pins being substantially vertically aligned when viewed in a shooting position.

2. The bow sight of claim 1, wherein said plurality of sight pins include sight pins oriented at angles relative to a vertical plane of approximately 40 degrees, 45 degrees and 58 degrees.

3. The bow sight of claim 1, wherein each of said plurality of sight pins are fixedly attached to a respective one of said plurality of support structures.

4. The bow sight of claim 1, wherein each of said plurality of sight pins are integrally formed with a respective one of said plurality of support structures.

5. The bow sight of claim 1, wherein each of said sight points of said plurality of sight pins are spaced apart when viewed in a shooting position.

6. The bow sight of claim 1, wherein said proximal ends of said plurality of sight pins are positioned proximate a lower right hand portion of said sight window when viewed in a shooting position.

7. The bow sight of claim 1, wherein said proximal ends of said plurality of sight pins are positioned proximate a right side of said sight window when viewed in a shooting position.

8. The bow sight of claim 7, wherein one of said plurality of sight pins is horizontally oriented.

9. A bow sight, comprising:

at least one support structure;

a plurality of sight pins each having a base portion coupled to said at least one support structure, each base portion of said plurality of sight pins being generally visually aligned at a common position when viewed in a shooting position, the plurality of sight pins being stacked one behind the other when viewed in the shooting position;

each of said plurality of sight pins having a sight point proximate a distal end in vertical alignment with each of the other sight points of the other sight pins;

each of said plurality of sight pins having a length from the distal end to the base portion, the length of each of said plurality of sight pins being different from that of the other sight pins of said plurality; and each of said plurality of sight pins having a longitudinal axis, each longitudinal axis being at a different angle relative to vertical.

10. The bow sight of claim 9, wherein said plurality of sight pins include sight pins oriented at angles relative to a vertical plane of approximately 40 degrees, 45 degrees and 58 degrees.

11. The bow sight of claim 9, wherein said at least one support structure comprises a plurality of support structures and wherein each of said plurality of sight pins are fixedly attached to a respective one of said plurality of support structures.

12. The bow sight of claim 9, wherein said at least one support structure comprises a plurality of support structures and wherein each of said plurality of sight pins are integrally formed with a respective one of said plurality of support structures.

13. The bow sight of claim 9, wherein each of said sight points of said plurality of sight pins are spaced apart when viewed in a shooting position.

14. The bow sight of claim 9, wherein said at least one support structure defines a sight window.

15. The bow sight of claim 14, wherein each said base portion of said plurality of sight pins are positioned proximate a lower right hand portion of said sight window when viewed in a shooting position.

16. The bow sight of claim 14, wherein each said base portion of said plurality of sight pins are positioned proximate a right side of said sight window when viewed in a shooting position.

17. The bow sight of claim 16, wherein one of said plurality of sight pins is horizontally oriented.

18. A bow sight, comprising:

at least one support structure;

a plurality of sight pins each sight pin having a base portion coupled to said at least one support structure, each base portion of the plurality of sight pins being generally visually aligned at a common position with each sight pin branching out from the common position at a different angle, the plurality of sight pins stacked one behind the other when viewed in a shooting position, each sight pin supporting a sight point, the plurality of sight points being in substantial vertical alignment when viewed in a shooting position, each sight pin defining a length from the sight point end to the base portion, the length of each of said plurality of sight pins being different, each sight pin defining an effective longitudinal axis between said base portion and said sight point, and each effective longitudinal axis being at a different angle from a vertical axis extending through each of said sight points.

19. The bow sight of claim 18, wherein each of said plurality of sight pins are independently vertically adjustable relative to said at least one support structure.

20. The bow sight of claim 19, wherein each angle of each effective longitudinal axis is maintained relative to the vertical axis when said plurality of sight pins are vertically adjusted.

21. The bow sight of claim 18, wherein each said angle of each said effective longitudinal axis is between ninety and forty-five degrees.

22. The bow sight of claim 18, wherein each said angle of each said effective longitudinal axis is between about five degrees and eighty five degrees.

23. The bow sight of claim 18, wherein said at least one support structure comprises a plurality of support structures and wherein each of said plurality of sight pins are fixedly attached to a respective one of said plurality of support structures.

24. The bow sight of claim 18, wherein said at least one support structure comprises a pin plate and wherein each of said plurality of sight pins are vertically adjustably coupled to said pin plate.

25. The bow sight of claim 18, wherein each of said sight points of said plurality of sight pins can be spaced apart when viewed in a shooting position to allow visibility of a target between said sight points.

26. The bow sight of claim 18, wherein at least one of said plurality of sight pins is substantially horizontally oriented.

* * * * *